US012337945B2

(12) United States Patent
Winner et al.

(10) Patent No.: US 12,337,945 B2
(45) Date of Patent: Jun. 24, 2025

(54) WING RIG

(71) Applicant: Boards & More GmbH, Molln (AT)

(72) Inventors: Ken Winner, Oberhaching (DE); Ralf Grösel, Oberhaching (DE)

(73) Assignee: Boards & More GmbH, Molln (AT)

( * ) Notice: Subject to any disclaimer, the term of this patent is extended or adjusted under 35 U.S.C. 154(b) by 555 days.

(21) Appl. No.: 17/772,949

(22) PCT Filed: Oct. 29, 2020

(86) PCT No.: PCT/EP2020/080453
§ 371 (c)(1),
(2) Date: Apr. 28, 2022

(87) PCT Pub. No.: WO2021/084036
PCT Pub. Date: May 6, 2021

(65) Prior Publication Data

US 2022/0371710 A1 Nov. 24, 2022

(30) Foreign Application Priority Data

Oct. 31, 2019 (DE) ..... 102019129496.7
Aug. 25, 2020 (DE) ..... 102020122143.6

(51) Int. Cl.
*B63H 8/10* (2020.01)

(52) U.S. Cl.
CPC ..... *B63H 8/10* (2020.02)

(58) Field of Classification Search
CPC ... B63H 8/10; B63H 8/12; B63H 8/14; B63H 8/40
See application file for complete search history.

(56) References Cited

U.S. PATENT DOCUMENTS

| | | | | |
|---|---|---|---|---|
| 4,563,969 | A | 1/1986 | Le Bail | |
| 4,858,854 | A * | 8/1989 | Jacobson | B63H 8/20 114/39.13 |
| 5,448,961 | A | 9/1995 | Ansteensen | |
| 2005/0230556 | A1 * | 10/2005 | Legaignoux | B64C 31/06 244/153 R |

FOREIGN PATENT DOCUMENTS

| | | | |
|---|---|---|---|
| DE | 10 2019 101 656 | 7/2020 | |
| FR | 2 841 213 | 12/2003 | |
| FR | 2 963 607 | 2/2012 | |
| FR | 3 098 187 | 1/2021 | |
| FR | 3098187 A1 * | 1/2021 | B63H 8/10 |
| WO | WO 84/03868 | 10/1984 | |
| WO | WO 95/05973 | 3/1995 | |
| WO | WO 2016/059179 | 4/2016 | |

OTHER PUBLICATIONS

German Office Action dated Jul. 8, 2024 from German Application No. 10 2020 122 143.6.

(Continued)

*Primary Examiner* — Andrew Polay
(74) *Attorney, Agent, or Firm* — Beyer Law Group LLP

(57) ABSTRACT

Disclosed is a hand-held wing rig for wind-powered sports, which is provided with a stiffening element for stiffening the front tube.

14 Claims, 4 Drawing Sheets

(56) References Cited

OTHER PUBLICATIONS

International Search Report dated Feb. 16, 2021 from International Application No. PCT/EP2020/080453.
Written Opinion dated Feb. 16, 2021 from International Application No. PCT/EP2020/080453.
Hocquinghem, Stephane "Wing Surf Swing la nouvelle aile de F-One / Foil Magazine, toute l'information du foil ou hydrofoil", Jun. 24, 2019, https://foil-magazine.com/wing-surf-decouvrez-une-nouvelle-dimension-du-sup-avec-la-swing-de-f-one/, retrieved from the internet Apr. 25, 2022.
European Office Action dated May 25, 2023 from European Application No. 20 800 112.3-1009.
European Office Action with English machine translation dated Nov. 19, 2024 from European Application No. 20800112.3.

* cited by examiner

WING RIG

The invention relates to a hand-held wing rig for wind-powered sports, for example foil surfing, according to the preamble of claim 1.

Wing rigs are described, for example, under the name of "Slingwing", "Foil wing", "Wing surfer" on the Internet. They are wings realized in the manner of a kite with a front tube forming a leading edge and a single strut, which are preferably inflatable. Holding straps are formed on the central strut and on the front tube via which the user holds the inflatable wing rig during use, for example during foiling or ice skating or skiing.

U.S. Pat. No. 4,563,969 shows a rigid wing rig, in which the leading edge and a boom are formed by a complex tubular structure spanning a canopy. The leading edge is curved in an arc as seen in a plan view. The boom is supported by a plurality of struts on the leading edge. These struts are designed in such a way that they give the leading edge—seen in a front view, i.e. in the direction of inflow of the wing rig—a concave structure in which the end portions (tips) of the wing rig extend upwards from a central vertex of the leading edge.

A disadvantage of this solution is that due to the complex structure of the boom and the leading edge, the total weight of the wing rig is very high, so that its use in water sports is only possible with appropriate buoyancy bodies. Another disadvantage is that the assembly and disassembly of the wing rig takes a long time due to the complex tube structure. The hard tubular structure of leading edge and boom is also accompanied by a significant risk of injury to the user in the event of a skidding fall.

A similar rigid wing rig is shown in WO 95/05973 A1. Also in this solution, the leading edge and the boom are formed by a complex tubular structure. The structure shows the same disadvantages as the wing rig according to U.S. Pat. No. 4,563,969 discussed above.

Document U.S. Pat. No. 5,448,961 describes a flat wing rig with a closed frame structure—such a solution is also unusable for water sports due to the high weight, time-consuming assembly/disassembly and risk of injury.

When using such wing rigs, it became apparent that, in particular in the case of inflatable wing rigs, the inflow profile is relatively soft and is deflected under unfavorable conditions, for example in gusty winds or with strong waves, so that an optimum inflow is not guaranteed.

In contrast, the object of the invention is to provide a hand-held wing rig that maintains an aerodynamic profile with a simple structure.

This object is achieved by a hand-held wing rig comprising the features of claim 1.

Advantageous developments of the wing rig are the subject matter of the subclaims.

The hand-held wing rig according to the invention is designed for wind-powered sports and has an inflatable front tube from which a boom extends, so that a support structure is formed which spans a canopy. According to the invention, a stiffening element is provided via which the inflatable front tube is stiffened or supported preferably in the longitudinal direction thereof. This stiffening element can, in turn, be supported on the boom and engage the front tube. The stiffening element can also be braced with the front tube.

This stiffening element stabilizes the profile of the wing rig even under unfavorable conditions, so that it is possible, for example, to form at least the front tube with a smaller cross-section than in conventional solutions, so that the flow resistance is reduced while having optimum profile stiffness.

According to one embodiment of the invention, the stiffening element is attached to the front tube in a replaceable manner. In principle, however, it is also possible to integrate the stiffening element into the front tube.

According to one variant, the stiffening element is designed as a stiffening rod which is braced with the front tube.

A portion of the stiffening element can, for example, be inserted in pockets or holders of the front tube. These pockets can, for example, be designed in the manner of a sail batten pocket. In principle, however, it is also possible to merely fix the end portions and/or, if necessary, additionally middle portions of the stiffening element by means of suitable holders.

The stiffening element can be lath-shaped or also designed as a profiled body.

In one variant, the stiffening element is approximately T-shaped so that it also stiffens the boom.

In one exemplary embodiment, the wing rig is designed with an inflatable center strut. In principle, however, the invention can also be used for solutions with a rigid, preferably tubular, boom.

In a development of the invention, the profiled body is designed to be inflatable.

In a variant of this type, for example, the boom, which is also designed to be inflatable, can be attached to this profiled body, which, in turn, is attached to the front tube in the central region diametrically relative to the leading edge. In other words, the inflatable profiled body supports the front tube on that side to which the boom is attached. It is here preferred for this profiled body to be tapered toward its end portions.

The front tube, the boom (center strut) and the profiled body can be filled via a one-pump system or via individual valves.

The stiffening can be improved when several stiffening elements are attached to the front tube and/or the center strut.

The stiffening element can, for example, be made of a sandwich material, a profiled body or a fiber-reinforced plastic material.

In particular in solutions in which the boom is rigid, e.g. made from a tubular profile, it can be advantageous for the stiffening element to engage with each of its end portions on the front tube and be supported centrally on the boom, so that the boom and the stiffening element form a kind of cross structure. In this case, the stiffening element may consist of two struts, each of which is supported on the boom.

In such an exemplary embodiment, the stiffening element can be slightly V-shaped.

In a further, very dimensionally rigid variant, the rigid boom is supported on the canopy side on the front tube. This means that, when the wing rig is positioned horizontally, the boom engages the front tube offset upwards towards the canopy. The wing rig is then preferably designed with a comparatively large handle in the manner of a wishbone boom spar, which engages the front tube approximately diametrically relative to the boom and the trailing edge-side end portion of which is then supported on the actual boom. This handle can be designed to be curved in order to improve the holding comfort.

The length of the handle can be adjustable to change the wing profile.

Preferred exemplary embodiments of a wing rig according to the invention are explained in more detail below with reference to schematic drawings. In the drawings.

Figure 1:
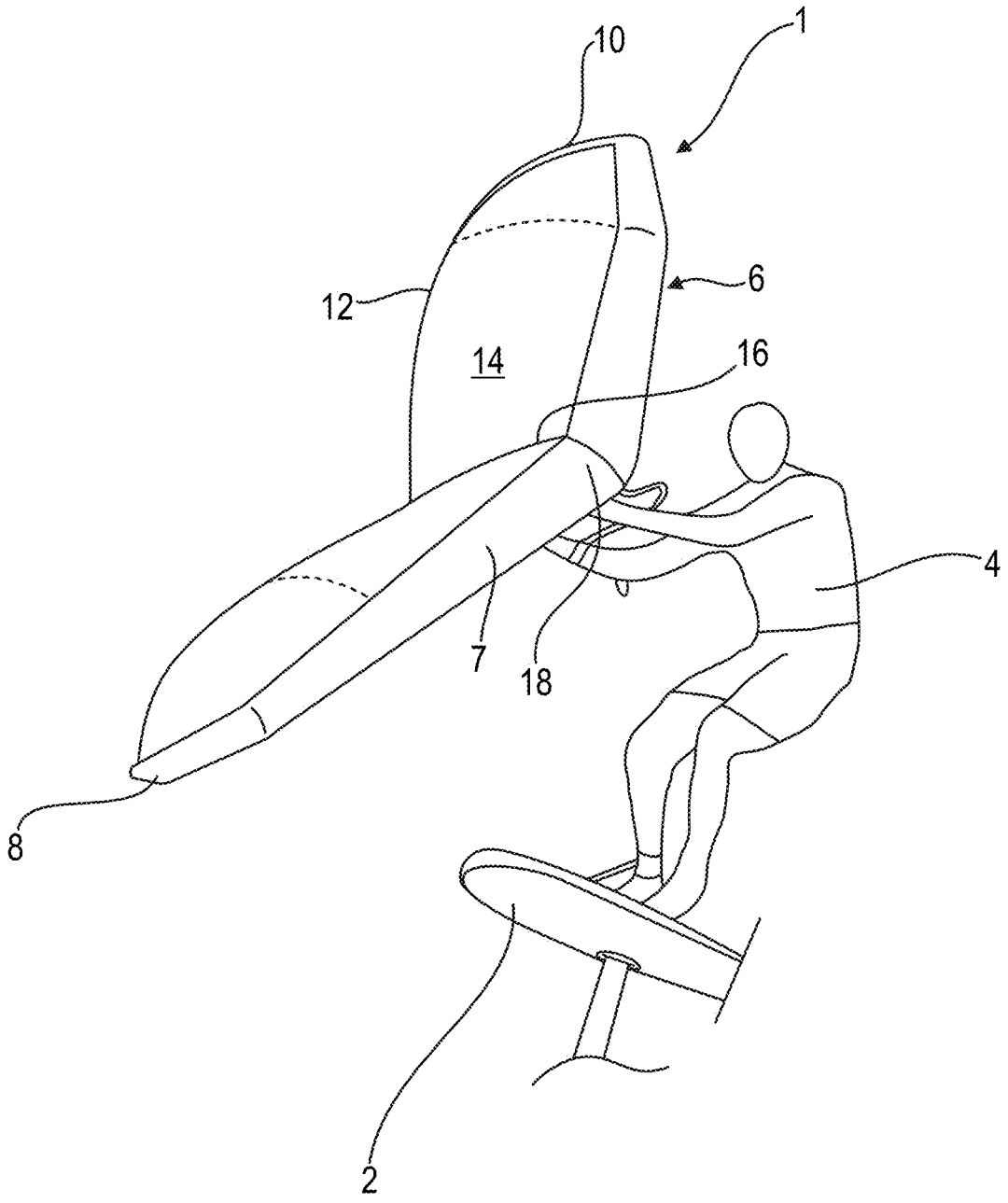
FIG. 1 shows a schematic diagram of the use of a wing rig employed to propel a foil board.

FIG. 1 illustrates the use of a wing rig 1 according to the invention to propel a foil board 2. In this case, a surfer 4 holds the wing rig 1 with his hands only and sets it with reference to the wind depending on the desired direction of travel (close to the wind, half-wind, tailwind) or the lift to be set, for example when jumping or adjusting the ride height (immersion depth of the foil) and depending on the wind strength and the swell.

The wing rig 1 has an inflatable front tube 6, which forms a leading edge 7, is approximately arcuate in a plan view and extends with tips 8, 10 to a trailing edge 12 of a canopy 14 of the wing rig 1. This canopy is spanned, on the one hand, by the front tube 6 and, on the other hand, by an inflatable center strut 16, which together form a support structure of the wing rig 1. The surfer here holds the wing rig 1 only at the center strut 16, which bulges downward in the view according to FIG. 1 and according to FIG. 2. As explained in an earlier application, DE 10 2019 101 656.8, the description of which is hereby expressly referred to, the front tube 6 is angled in an approximately V- or U-shaped manner in both the top view and a front view—as seen in the direction of inflow—, the V/U widening upwards, i.e. away from the surfer, in the front view. As can be seen in FIG. 1, the trailing edge 12, and thus the entire canopy surface 14, is also angled in a V-shaped manner in the front view or in a rear view.

Figure 2:
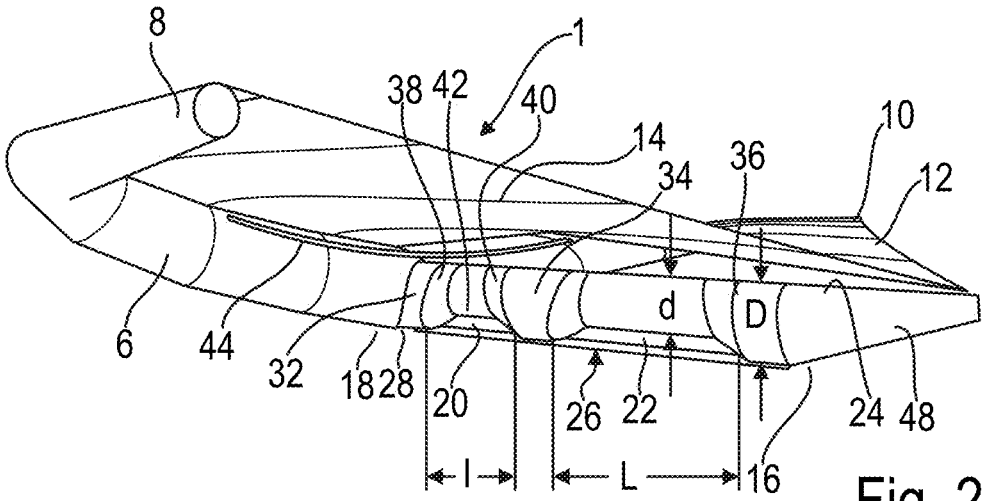
FIG. 2 shows a three-dimensional side view of a wing rig as shown in FIG. 1.

FIG. 2 shows a three-dimensional side view of the wing rig 1. It can be seen that the wing rig 1 is formed in an approximately U-shaped manner in a top view according to FIG. 3 described below and tapers away from a vertex 18 towards the two tips 8, 10. The center strut 16 is connected in the region of the vertex 18, reinforcements which are not shown being provided in the connection region in order to optimize the force introduction between the center strut 16 and the leading edge (front tube) 6.

In the exemplary embodiment shown in FIG. 2, the center strut 16 is designed so as to vary in diameter so that two grip recesses 20, 22 are formed, in the region of which the diameter d of the center strut 16 is smaller than the diameter D of the adjacent strut portions. As can be seen from FIG. 2, however, these grip recesses 20, 22 are preferably not formed along the entire circumference but only in the region of the center strut 16 facing away from the canopy 14. A canopy-side circumferential surface area 24 is formed continuously without a step. The term "diameter" is understood to mean the extension of the center strut 16 in the view according to FIG. 2. A round cross-section is not assumed in this case, but a cross-section deviating therefrom, for example an oval or rounded, e.g. trapezoidal, cross-section, can also be used.

The leading edge-side grip recess 20 in FIG. 2 has a shorter length l than the trailing edge-side grip recess 22, which is made with a length L that is at least 1.5 times, preferably more than 2 times, the length l of the front grip recess 20. The greater length L gives the surfer 4 the opportunity to adapt the rear, trailing edge-side hand position very quickly according to the angulation of the wing rig 1 so as to facilitate the execution of the above described maneuvers.

For holding purposes, a holding bar 26 bridges the two grip recesses 20, 22 in the illustrated exemplary embodiment and is attached to the circumferential area 28 located at the bottom in FIG. 2 and at a distance from the canopy 14. In the illustrated exemplary embodiment, a holding bar 26 bridges both grip recesses 20, 22. In principle, it is also possible to assign a separate holding bar to each grip recess 20, 22.

In the illustrated exemplary embodiment, the holding bar 26 is fixed to strut portions 32, 34, 36 laterally adjacent to the grip recesses 20, 22. This attachment can be made in a detachable manner, for example by means of pockets or the like, which are designed in the manner of a batten pocket and allow a flexurally rigid connection of the holding bar 26. This is particularly advantageous since a torque can then also be applied via the holding bar 26, connected in a torsionally and flexurally rigid fashion, to the center strut 16 for a transverse angulation of the wing rig 1—as mentioned above, this is not possible with the conventional holding straps.

The holding bar 26 can be made from a comparatively rigid molded part. In principle, it is also possible to surround a comparatively flexurally and torsionally rigid core with a comparatively soft shell optimized for grip in order to improve grip comfort. In a concept in which the holding bar 26 or the holding bars 26 are held at the center strut 16 in a replaceable manner, this bending stiffness and the ability to transmit torque can be adapted by replacing the holding bars 26. For example, it can be advantageous for beginners to make the holding bars 26 somewhat softer so that unintended hand movements are not directly transmitted to the wing rig 1. Experienced surfers will then prefer rigid holding bars 26 due to the direct transmission of force. The holding bar 26 also increases the stiffness of the center strut 16.

In the exemplary embodiment illustrated in FIG. 2, the grip recesses 20, 22 are approximately designed to be trapezoidal in the lateral view visible therein. Accordingly, the grip recesses 20, 22 are each bounded laterally by two inclined surfaces 38, 40 (only provided with reference signs in the case of grip recess 20), via which the actual diameter is reduced and which then merge into a bar 42, which is designed with diameter d according to the illustration in FIG. 2. The cross-section in the region of this bar 42 is then correspondingly ovalized, the width (perpendicular to the drawing plane) being greater in the region of the circumferential surface area 24 than in the portions facing the holding bars 26. The center groove 16 in the region of the grip recess 20. 22 thus tapers asymmetrically.

As further illustrated in FIG. 2, the end portion 48 of the center strut 16 adjoining the grip recess 22 is tapered towards the trailing edge 12.

Figure 3:
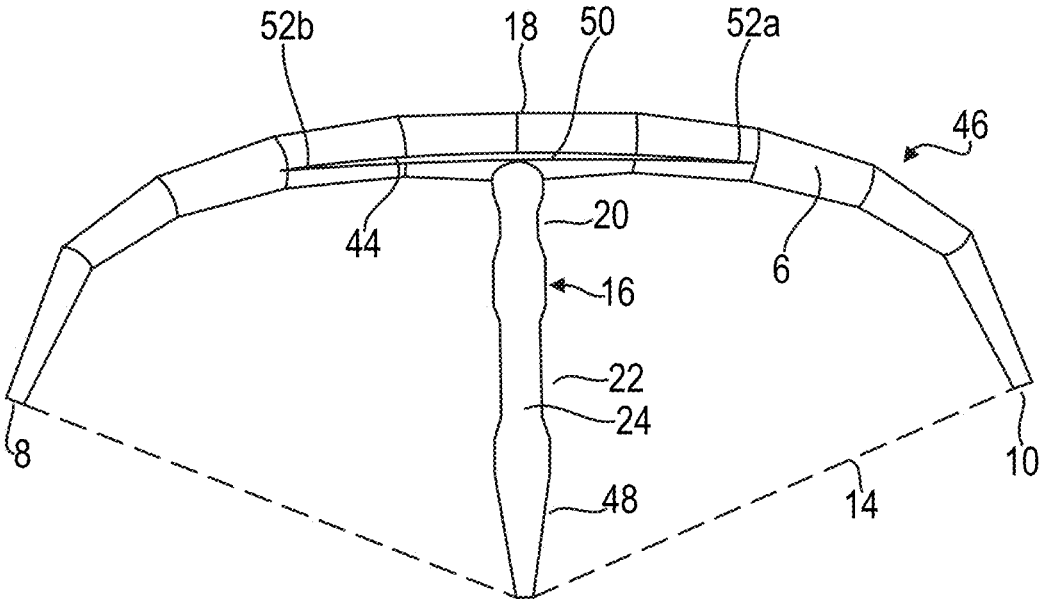
FIG. 3 shows a schematic top view of a support structure of the wing rig according to FIGS. 1 and 2.

FIGS. 2 and 3 illustrate a further feature of an exemplary embodiment of a wing rig 1 according to the invention. In order to improve the bending/torsional stiffness, the front tube 6 is accordingly designed with a stiffening element 44, the function of which is explained with reference to FIG. 3.

This drawing shows a top view of a support structure 46, which is formed by the leading edge (front tube 6) and the center strut 16 connected thereto and which spans the canopy 14 of the wing rig 1, indicated by dashed lines. In the exemplary embodiment shown in FIG. 3, the lateral regions of the two grip recesses 20, 22 are shown. However, the stiffening element 44 described below can also be used for wing rigs 1 which use a boom made from a tubular profile according to DE 10 2019 101 656 A1 or a continuous center strut 16 without grip recesses 20, 22.

In the illustration according to FIG. 3, the approximately U-shaped curvature of the front tube 6 is shown in a plan view, the center strut 16 being attached to the vertex 18 of the front tube 6. A portion of the stiffening element 44 extends centrally approximately along the longitudinal axis of the front tube 6. The stiffening element 44 can here be a stiffening rod which is designed in the manner of a sail batten. This rod can, for example, be made of a sandwich material, of carbon fiber, of an aluminum profile or the like.

In one exemplary embodiment, it is intended to integrate this stiffening element 44 into the outer skin of the front tube 6. Alternatively, however, it is also possible to attach thereto pockets or holders, via which the stiffening element 44 is attached to the front tube 6 in a replaceable manner. In this case, for example, stiffening elements 44 with different stiffnesses can be provided to allow an adaptation to different wind and wave conditions.

In the illustrated exemplary embodiment, the stiffening element 44 extends approximately transversely to the center strut 16, and is attached in such a way that, when the support structure 46 is inflated, for example via a valve arranged on the front tube 6 and a one-pump system, the stiffening element 44 is braced with the support structure 46 so that undesirable twisting of the support structure 46 under high loads can be prevented or at least reduced. The stiffening element 44 can also be designed in accordance with the desired V-/U-angulation of the front tube 6. In this way, a stable wing profile is provided that ensures optimum inflow even under different operating conditions.

The stiffening element 44 can, in turn, be profiled so that, for example, a central region 50 is realized with greater bending/torsional stiffness than that of end regions 52*a*, 52*b*. In principle, it is also possible to form the stiffening element 44 itself approximately with a T-shape so that a portion thereof also extends along the center strut 16 and thus stiffens it—at least in the connection region.

In one exemplary embodiment, the support structure 46 is formed with a plurality of such stiffening elements 44, it being possible to provide separate stiffening elements, for example, for profiling the front tube 6 in the region of the tips 8, 10. As illustrated in FIGS. 2 and 3, the stiffening elements 44 can be formed in the connection region of the center strut 16 above (view according to FIGS. 2, 3) or also below.

As explained above, the stiffening elements 44 can be curved or profiled according to the desired U-shape of the front tube 6. The use of such stiffening elements 44 according to the invention in the support structure 46 makes it possible to design the latter with a somewhat smaller cross-section so that, despite the smaller diameter, the predetermined profile of the wing rig 1 is maintained even in gusty conditions or in strong waves and also during complex maneuvers with minimum weight. The narrow profile here significantly reduces the flow resistance of the wing rig 1 as compared to conventional solutions so that with minimized weight the handling characteristics are superior to conventional solutions.

According to the invention, it is preferred to hold the stiffening elements 44 at the support structure 46 in a replaceable manner so that the wing rig 1 can be compactly folded after deflating and after removing the stiffening elements 44. This replaceability also provides the opportunity of making the profile of the support structure 46 stiffer or softer by omitting or varying the stiffening elements 44.

Figure 4:
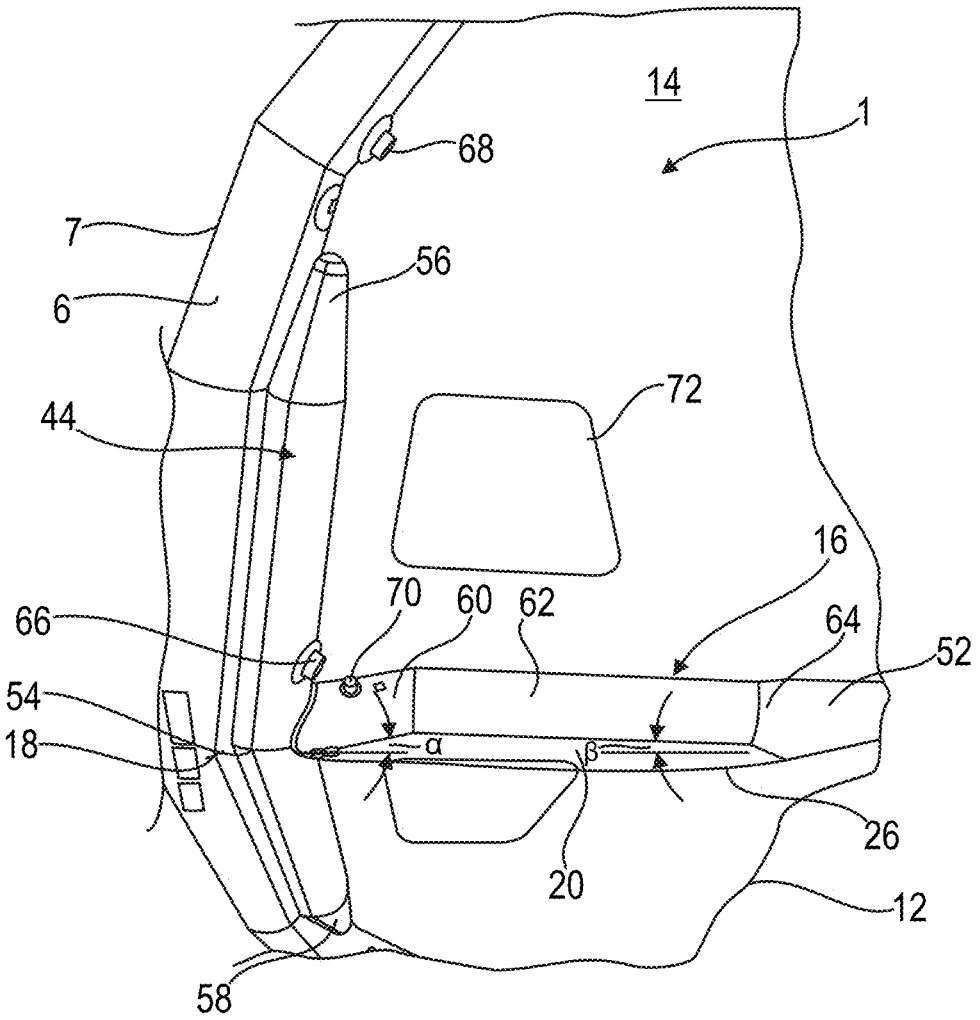
FIG. 4 shows an exemplary embodiment in which a stiffening element is designed to be inflatable.

FIG. 4 shows an exemplary embodiment of a wing rig in which the stiffening element 44 is not formed as a rigid profile but as an inflatable structure in the manner of the center strut 16 or the front tube 6. Accordingly, the stiffening element 44 is tubular in cross-section, for example, with a sealing bladder and a robust outer skin.

This stiffening element 44 is formed on the side facing away from the leading edge 7 (rear side) of the front tube 6 in the central region thereof and accordingly supports the profile of the front tube 6 very effectively. The stiffening element 44 here extends approximately parallel to the front tube 6. In this case, the stiffening element 44 is connected to the front tube 6 along a contact surface that is narrow in the circumferential direction. This connection can be achieved, for example, by sewing, gluing and/or welding. In principle, the inflatable stiffening element 44 can also be integrated into the front tube 6 as an additional chamber.

In the illustrated exemplary embodiment, the inflatable stiffening element 44 is slightly V-shaped, similar to the front tube 6 (view according to FIG. 4) so that a vertex 54 of the stiffening element 44 is arranged at a parallel distance from the vertex 18.

The end portions 56, 58 of the stiffening element 44 which are remote from the center strut 16 are tapered so that the support of the front tube 6 is maximized in the central region. In the illustrated exemplary embodiment, the center strut 16 is attached to the vertex region 54 of the stiffening element 44. In this case, the center strut 16 has a single grip recess 20 designed by an angulation of the center strut 16. For this purpose, the center strut 16 has a comparatively short strut leg 60, which is supported on the stiffening element 44 and is angled relative to the longitudinal axis of the center strut 16 by an angle $\alpha$ in an upward direction towards the canopy 14. Adjacent to this strut leg 60 is a further, longer strut leg 62, which forms a V-structure with the strut leg 60 and which is positioned at an angle $\beta$ relative to the longitudinal axis of the center strut. The angle $\beta$ is here smaller than the angle $\alpha$. The strut leg 60 then transitions via a tapered transition region 64 of the center strut 16 into the above described end region 52, which extends in a tapering manner toward the trailing edge 12.

In the illustrated exemplary embodiment, the front tube 6 and the stiffening element 44 are filled in each case via a valve 66, 68, which is used in kites, for example. A valve of this type is described in WO 2016/059179 A1 of the applicant. In the illustrated exemplary embodiment, the center strut 16 is filled via a valve 70 made as a check valve—of course, a valve as is used for filling the front tube 6 and the stiffening element 44 can also be used here. The three inflatable elements (front tube 6, stiffening element 44 and center strut 16) can thus be filled with different pressures, so that depending on the wind strength and the preferences of the user, the profile can also be influenced by varying the filling pressure. Reference sign 72 in the illustration according to FIG. 4 indicates a window through which the user's view is improved.

Similar to what is described in the parallel patent application DE 10 2019 129 501 A1, the user guides the wing rig 1 by means of a handle which, in the illustrated exemplary embodiment, is designed as a holding bar 26, which bridges the grip recess 20, which is approximately trapezoidal in cross section and is formed by the angulation of the strut legs 60, 62 and the adjoining conical transition region 64. This holding bar 26 can be fastened, on the one hand, to the tapering end region 52 and, on the other hand, to the stiffening element 44 and/or to the front tube 6. This attachment can be exchangeable so that the holding bar 26 can be easily removed or replaced with another variant having greater or lesser rigidity or a different geometry.

With respect to further details of the grip recess 20 and the holding bar 26, reference is made to the patent family relating to the above-mentioned patent application.

Figure 5:
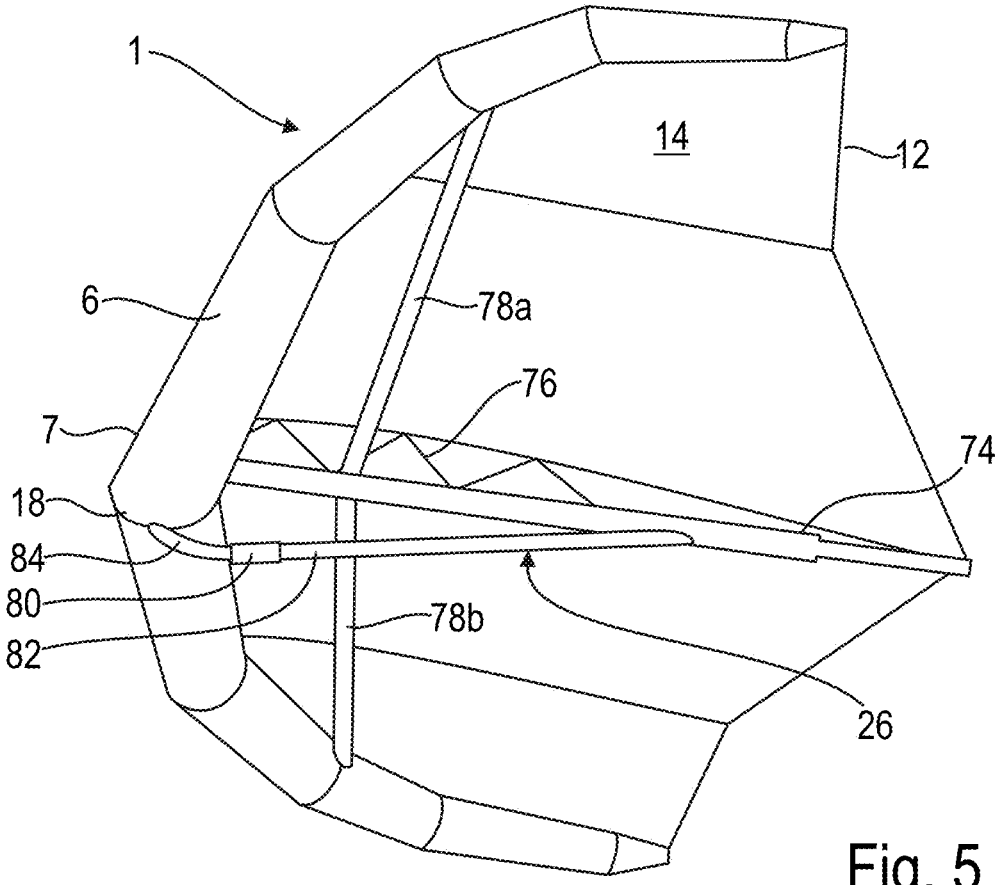
FIG. 5 shows an exemplary embodiment with a rigid support structure in a three-dimensional view from below.
Figure 6:
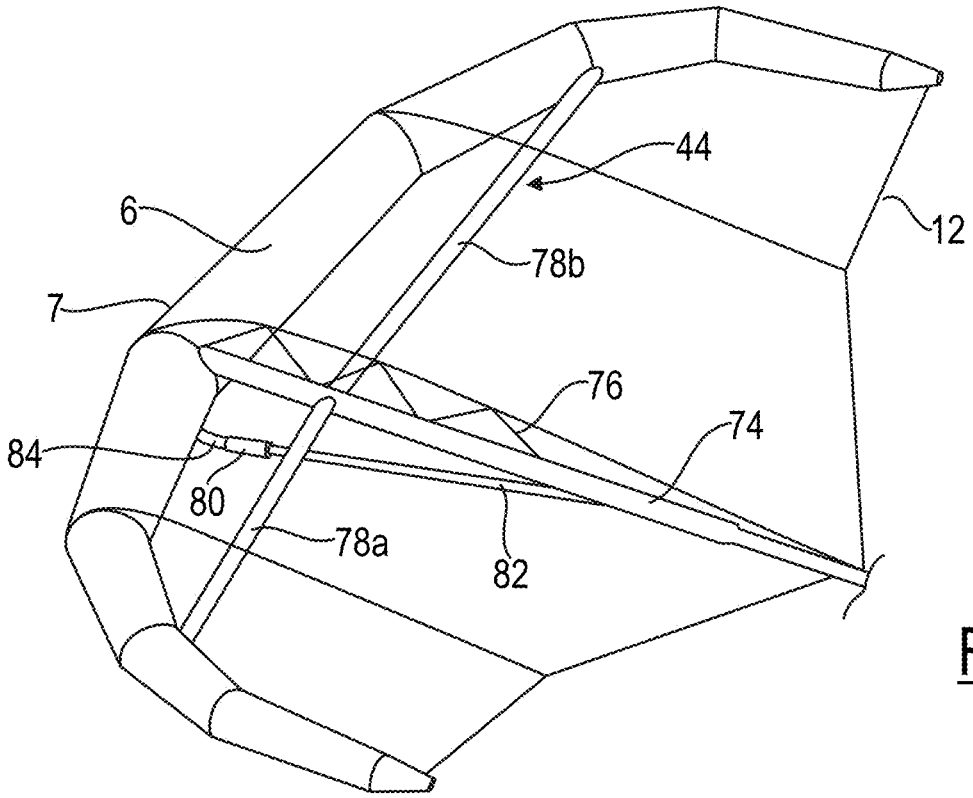
FIG. 6 shows the exemplary embodiment according to FIG. 5 from above with the canopy being shown in transparent fashion.

In the above-described exemplary embodiments, the center strut 16 is designed to be inflatable. FIGS. 5 and 6 are used to explain an exemplary embodiment in which instead of the center strut 16 a flexurally rigid boom is used which is formed, for example, from a tubular profile 74.

According to the view from below as shown in FIG. 5, this tubular profile 74 is attached, on the one hand, in the region of the vertex on the canopy side, i.e. to the upper side of the front tube 6 facing away from the viewer in FIG. 5, and extends with its end portion remote therefrom towards the trailing edge 12 of the wing rig 1. In this exemplary embodiment, the canopy 14 is bulged out with respect to the tubular profile 74 forming the boom, the flow profile being stabilized in the region of this boom by a zigzag-shaped profile support 76 extending between the tubular profile 74 and the canopy 14. This profile support 76 can be formed, for example, by a rope which is guided in a zigzag shape and the tension of which can be variable in some circumstances so that the profile is adjustable by lengthening or shortening the rope. Instead of such a flexible design it is, of course, also possible to provide a rigid profile support 76 by means of profiled bodies or by means of a cloth or the like inserted in the space between the profiled body 74 and the canopy 14.

In the exemplary embodiment illustrated in FIG. 5, the stiffening element 44 is formed by two stiffening profiles 78*a*, 78*b*, which are angled in an approximately V-shaped manner and are supported on the tubular profile 74 at a distance from the front tube 6. The end portions remote therefrom each engage the front tube 6 to stiffen it in its longitudinal direction and also in profile. This V-structure of the stiffening element 44 can here be formed in such a way that it opens backwards, towards the trailing edge 12, in both the direction of inflow and the bottom view.

For guiding the wing rig 1, a handle or holding bar 26 is provided, which is designed in the broadest sense in the manner of a wishbone boom spar and which is attached, on the one hand, in the region of the vertex 18 to the front tube 6 and, on the other hand, approximately in the last third of the tubular profile 74 (boom). In the illustrated exemplary embodiment, this holding bar 26 is designed to be slightly curved downwards (view according to FIG. 5). The effective length of the holding bar 26 can here be changed telescopically by means of an adjusting device 80 so that the profile can accordingly be made flatter or more bulbous by shortening or lengthening the holding bar 26.

This adjusting device 80 connects a straight leg 82 to an inflow-side curved leg 84 of the holding bar 26, which engage telescopically in one another and can be fixed in position by means of the adjusting device 80. In principle, a push-pin system can also be used for this position fixing.

In principle, the tubular profile 74 can also be designed as a telescopic profile so that the length of the boom can be changed. The curved design of the leg 84 facilitates guiding the wing rig 1 during a tack or a jibe or when holding the wing rig 1 in the wind (without significant propulsion).

FIG. 6 shows a top view of the wing rig 1 according to FIG. 5, the canopy 14 being shown transparently. This illustration shows the tubular profile 74, which is designed in such a way that it can be telescoped, engages the front tube 6 in a region remote from the leading edge 7 and extends towards the trailing edge 12. The canopy 14 bulges upwardly in the illustration according to FIG. 6, the profile being stabilized by means of the profile support 76. The shape of the front tube 6 is stabilized via the stiffening element 44, which is formed as described above by the two stiffening profiles 78*a*, 78*b*, which are angled in a V-shape relative to one another and which engage, on the one hand, with the tubular profile 74 and, on the other hand, with the front tube 6 so that the wing rig 1 is stiffened by the cross-shaped structure consisting of the stiffening element 44 and the boom (tubular profile 74). In the illustration according to FIG. 6, the curved holding bar 26 extends below the canopy 14 and a portion thereof is covered by the front tube 6 in the illustration according to FIG. 6. As explained, the curved leg 84 engages the bottom side (view according to FIG. 6) of the front tube 6 while the straight leg 82 is supported on the tubular profile 74.

The concept according to FIGS. 5 and 6 allows the wing rig 1 to be adjusted to a relatively large extent by altering the length of the profiled body 74 and/or the holding bar 26 and/or the profile support 76, in each case ensuring reliable stabilization of the wing rig profile. In principle, mixed forms can also be realized, in which, for example, an inflatable center strut 16 is supported on the front tube 6 via a stiffening element 44 arranged crosswise thereto, for example with the two stiffening profiles 78*a*, 78*b*. Likewise, it is conceivable to additionally stabilize the tube structure according to FIGS. 5 and 6 via an inflatable stiffening element 44 according to FIG. 4.

Disclosed is a hand-held wing rig for wind-powered sports, which is provided with a stiffening element for stiffening the front tube.

LIST OF REFERENCE SIGNS

1 wing rig
2 foil board
4 surfer
6 front tube
7 leading edge
8 tip
10 tip
12 trailing edge
14 canopy
16 center strut
18 vertex
20 grip recess
22 grip recess
24 circumferential surface area
26 holding bar
28 circumferential area
32 strut portion
34 strut portion
36 strut portion
38 lateral surface
40 lateral surface
42 bar
44 stiffening element/stiffening rod
46 support structure
48 end portion
50 central region
52 end region
54 vertex of the stiffening element
56 end portion
58 end portion
60 strut leg
62 strut leg
64 conical transition region
66 valve

68 valve
70 filling valve
72 window
74 tubular profile
76 profile support
78*a, b* stiffening profile
80 adjusting device
82 straight leg
84 curved leg

The invention claimed is:

1. A hand-held wing rig for wind-powered sports, comprising an inflatable front tube from which a boom extends, which is designed as a rigid or inflatable center strut, the front tube and the boom spanning a canopy, characterized by at least one stiffening element stiffening the front tube or being braced therewith.

2. The wing rig according to claim 1, wherein the stiffening element is attached to the front tube in a replaceable manner.

3. The wing rig according to claim 1, wherein at least a portion of the stiffening element is inserted into pockets/holders of the front tube.

4. The wing rig according to claim 1, wherein the stiffening element has a stiffening rod, a sail batten or a profiled body.

5. The wing rig according to claim 4, wherein the stiffening element is designed as an inflatable profiled body.

6. The wing rig according to claim 5, wherein the boom is attached to the inflatable stiffening element, which, in turn is attached to the front tube approximately diametrically relative to a leading edge.

7. The wing rig according to claim 5, wherein the inflatable stiffening element is tapered towards end portions.

8. The wing rig according to claim 1, wherein the stiffening element also stiffens the boom or at least the transition region between boom and front tube.

9. A hand-held wing rig for wind-powered sports, comprising:

an inflatable front tube from which a boom extends, which is designed as a rigid or inflatable center strut, the front tube and the boom spanning a canopy; and at least one stiffening element stiffening the front tube or being braced therewith, wherein the stiffening element consists of a sandwich material, of a fiber-reinforced plastic material, or of an aluminum profile.

10. The wing rig according to claim 1, wherein a plurality of stiffening elements are provided.

11. A hand-held wing rig for wind-powered sports, comprising:

an inflatable front tube from which a boom extends, which is designed as a rigid or inflatable center strut, the front tube and the boom spanning a canopy; and at least one stiffening element stiffening the front tube or being braced therewith, wherein the stiffening element is supported centrally on the boom and engages with end portions on the front tube.

12. The wing rig according to claim 11, wherein the boom is supported on the canopy side on the front tube and wherein a handle/holding bar is provided, which is supported, on the one hand, approximately diametrically relative to the boom on the front tube and, on the other hand, on the boom.

13. The wing rig according to claim 4, wherein the stiffening element has said profiled body which is shaped in accordance with the desired contour of the front tube.

14. The wing rig according to claim 9, wherein the stiffening element consists of said fiber-reinforced plastic material which is a carbon fiber-reinforced plastic material.

* * * * *